US009270067B2

(12) United States Patent
Lin et al.

(10) Patent No.: US 9,270,067 B2
(45) Date of Patent: Feb. 23, 2016

(54) CONNECTOR FOR MULTI-INTERFACE CONNECTIONS

(71) Applicant: CHANT SINCERE CO., LTD., New Taipei (TW)

(72) Inventors: Chih-Chien Lin, New Taipei (TW); Chun-Hsiang Hsu, New Taipei (TW); Jason Yeh, New Taipei (TW)

(73) Assignee: Chant Sincere Co., Ltd. (TW)

( * ) Notice: Subject to any disclaimer, the term of this patent is extended or adjusted under 35 U.S.C. 154(b) by 44 days.

(21) Appl. No.: 14/166,985

(22) Filed: Jan. 29, 2014

(65) Prior Publication Data

US 2014/0287626 A1 Sep. 25, 2014

(30) Foreign Application Priority Data

Mar. 22, 2013 (TW) ..... 102211549 U
Jun. 20, 2013 (TW) ..... 102121912 A

(51) Int. Cl.
*H01R 9/03* (2006.01)
*H01R 24/78* (2011.01)
*H01R 31/06* (2006.01)

(52) U.S. Cl.
CPC ..... *H01R 24/78* (2013.01); *H01R 31/06* (2013.01)

(58) Field of Classification Search
CPC ..... H01R 13/658; H01R 13/65802; H01R 23/6873; H01R 23/7073; H01R 23/025
USPC ..... 439/607.55, 607.56, 638, 171, 607.25, 439/607.26
See application file for complete search history.

(56) References Cited

U.S. PATENT DOCUMENTS

| | | | | |
|---|---|---|---|---|
| 6,142,833 | A * | 11/2000 | Zhu et al. | 439/638 |
| 6,155,872 | A * | 12/2000 | Wu | 439/541.5 |
| 6,210,224 | B1 * | 4/2001 | Wu | 439/607.4 |
| 6,224,422 | B1 * | 5/2001 | Zhu et al. | 439/607.01 |
| 6,309,227 | B1 * | 10/2001 | Chen et al. | 439/79 |
| 6,319,061 | B1 * | 11/2001 | Chen et al. | 439/607.15 |
| 6,371,811 | B1 * | 4/2002 | Chen et al. | 439/607.37 |
| 6,419,529 | B1 * | 7/2002 | Shi et al. | 439/701 |
| 7,393,224 | B2 * | 7/2008 | Milan | 439/171 |
| 7,578,700 | B2 * | 8/2009 | Xiong et al. | 439/607.01 |
| 7,628,657 | B2 * | 12/2009 | Martich | 439/676 |
| 7,695,304 | B2 * | 4/2010 | Chiang et al. | 439/353 |
| 8,025,511 | B2 * | 9/2011 | Aihara et al. | 439/141 |
| 8,100,709 | B2 * | 1/2012 | Zhang | 439/353 |
| D680,962 | S * | 4/2013 | Lan | D13/147 |
| 8,517,748 | B1 * | 8/2013 | Kelsch et al. | 439/188 |
| 8,758,047 | B2 * | 6/2014 | Dietz et al. | 439/540.1 |
| 8,777,666 | B2 * | 7/2014 | Golko et al. | 439/607.34 |
| 8,801,467 | B2 * | 8/2014 | Lan | 439/607.36 |
| 8,814,599 | B2 * | 8/2014 | Wu | 439/607.48 |
| 8,864,520 | B2 * | 10/2014 | Lan | 439/607.01 |
| 2009/0289119 | A1 * | 11/2009 | Liao et al. | 235/441 |
| 2013/0052866 | A1 * | 2/2013 | Il | 439/607.41 |

* cited by examiner

*Primary Examiner* — Abdullah Riyami
*Assistant Examiner* — Vladimir Imas
(74) *Attorney, Agent, or Firm* — Bacon & Thomas, PLLC

(57) ABSTRACT

A connector comprises a first shell configuring with a first insulative portion having a first base portion and a first tongue portion to conform an first type interface, a second shell configuring with a second insulative portion having a second base portion and a second tongue portion to conform an second type interface and a terminal set, held in a housing, including a plurality of the first terminals and a plurality of the second terminals, wherein said terminal set is made up of a group comprising the first terminals and the second terminals and configuring the terminal set with a special arrangement.

16 Claims, 10 Drawing Sheets

| | | | |
|---|---|---|---|
| 31a | GND | 32a | GND<br>ID |
| 31b | D+ | 32b | D+ |
| 31c | D− | 32c | D− |
| 31d | VBUS | 32d | VBUS |

CONNECTOR FOR MULTI-INTERFACE CONNECTIONS

CROSS-REFERENCE TO RELATED APPLICATIONS

This application claims the benefit of the filing date under 35 U.S.C. §119(a)-(d) of Taiwan Patent Applications No. 102211549, filed Mar. 22, 2013 and No. 102121912, filed Jun. 20, 2013.

BACKGROUND OF THE INVENTION

1. Field of the Invention

The present invention relates generally to a connector, and more specifically, to a connector that provides the adaptiveness of different type connectors and an improving structure thereof.

2. Description of the Related Art

Taiwan Patent No. 568429, USB adapter displaying transmission status, comprising: a base installed two USB connectors, one AF; the other BM, connecting each other, providing to adapt interfaces among USB devices, is disclosed.

Two USB connectors are connected with a signal detect-display circuit in the electrical circuit inside the base so that detecting and displaying signal transmissions occurred in two USB interfaces is provided. The signal detect-display circuit consists of a transistor and a light-emitting diode (LED). Said transistor includes a base, via a resistor, connected to the electric circuit corresponding to the USB data lines, a collector connected to the electric circuit corresponding to the USB power line and an emitter connected to the electric circuit corresponding to the USB ground lines.

Above-mentioned adapter, however, must employ an electrical circuit to achieve adapter functions; it will not satisfy the miscellaneous applications in upcoming era.

SUMMARY OF THE INVENTION

For solving the situation occurred in the conventional art, therefore, it is necessary to modify the existing connector, thereto provide a better solution to adapt different type connectors into identical connector.

The present invention is ultimately to provide a connector, comprising: a first shell, having a first opening at the front end, an upper engaging portion and a lower engaging portion, configures with a first insulative portion having a first base portion and a first tongue portion to conform an first type interface; and a second shell, opposite to the first shell in longitudinal direction, having a second opening at the front end and at least one fitting portion, configures with a second insulative portion having a second base portion and a second tongue portion to conform an second type interface; and a terminal set, held in a housing composed of said first insulative portion and said second insulative portion, includes a plurality of first terminals and a plurality of second terminals, wherein said terminal set is made up of a group comprising: Contact A, Contact B, Contact C and Contact D defined by said first terminals, are generated longitudinally in one end of the connector to conform an first type interface, Contact E, Contact F, Contact G and Contact H defined by said second terminals, are generated longitudinally in the other end of the connector to conform an second type interface, and configuring said Contact A with said Contact E, said Contact B with said Contact F, said Contact C with said Contact G and said Contact D with said Contact H.

DETAILED DESCRIPTION OF THE EMBODIMENT(S)

Figure 3:
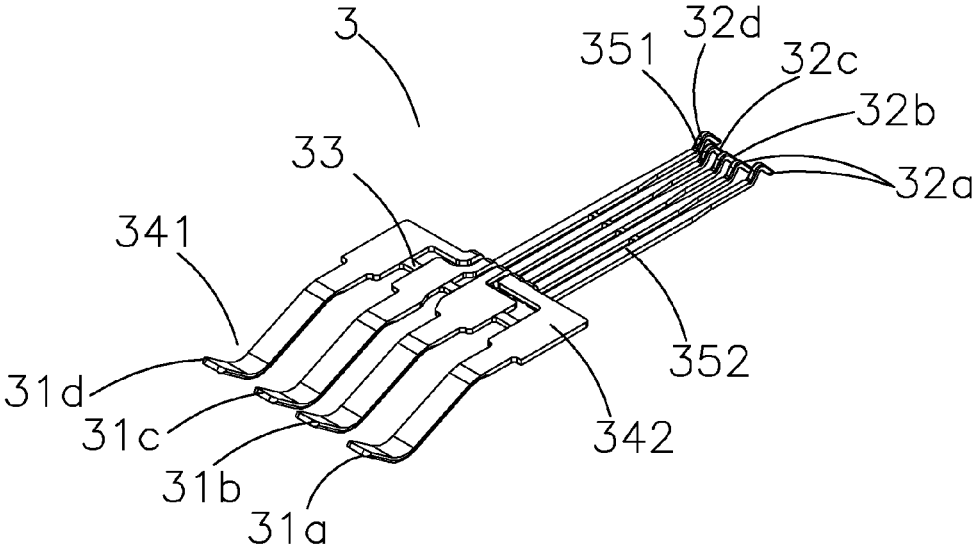
FIG. 3 is a perspective view of the terminal set formed in accordance with an embodiment of the invention.
Figure 4:
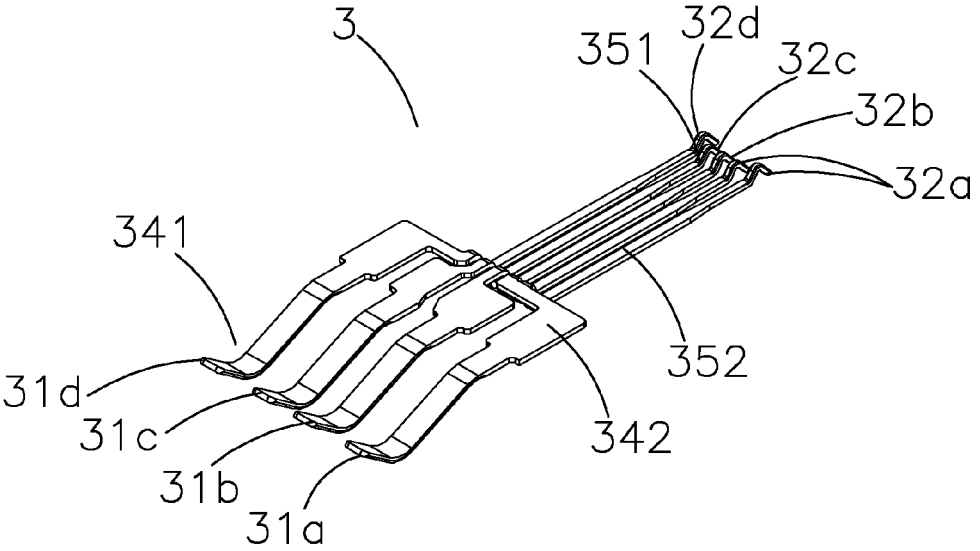
FIG. 4 is another perspective view of the terminal set formed in accordance with an embodiment of the invention.

FIG. 3 and FIG. 4 illustrate the perspective views of the terminal set 3 of the connector 9. FIG. 3 further reveals a plurality of bonds 33 of the terminal set 3 which had not shown in FIG. 4.

As shown in FIG. 3, the terminal set 3 includes a plurality of first terminals 31*a*, 31*b*, 31*c*, 31*d* and a plurality of second terminals 32*a*, 32*b*, 32*c*, 32*d*, wherein first terminals 31*a*, 31*b*, 31*c*, 31*d* and second terminals 32*a*, 32*b*, 32*c*, 32*d* longitudinally extend in opposite direction, and are configured with bonds 33 in one piece.

The bonds 33 later were removed. The terminal set 3 divides original one-piece into four minor sections, as shown in FIG. 4. Each first terminal has a first resilient contact 341 and a first terminal body 342; each second terminal has a second resilient contact 351 and a second terminal body 352.

Figure 5:
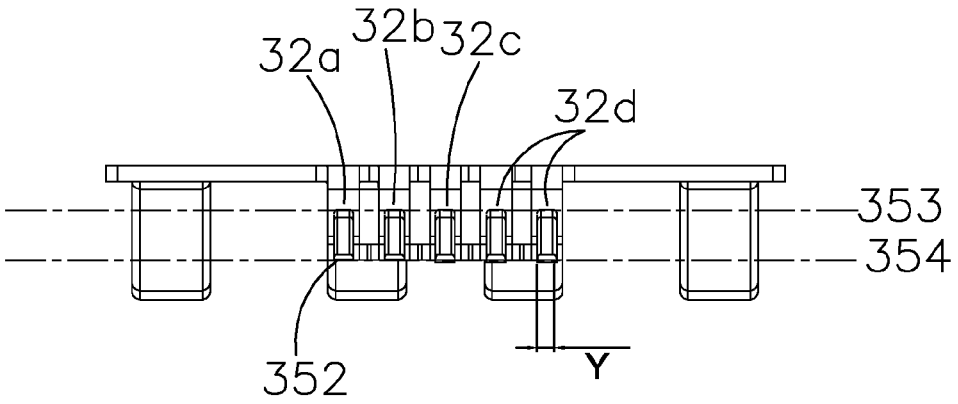
FIG. 5 is a front view shown in FIG. 4.
Figure 6:
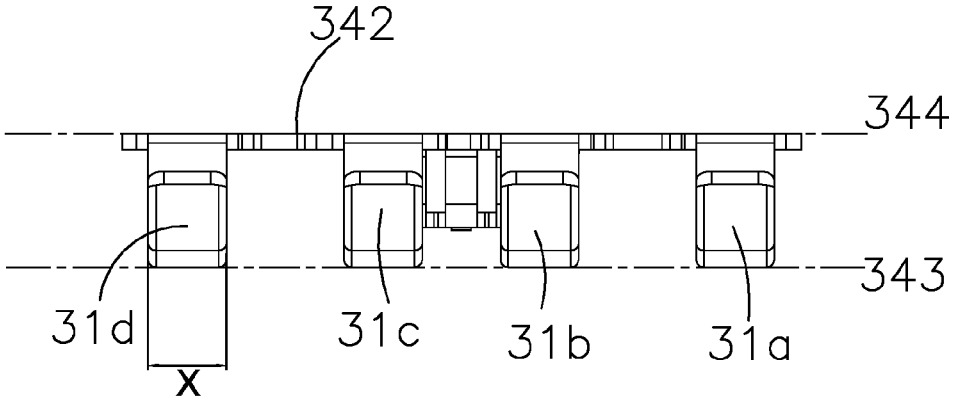
FIG. 6 is a rear view shown in FIG. 4.

FIG. 5 and FIG. 6 illustrate a front view and a rear view of the terminal set 3 of the connector 9.

Each first terminal, which came out from the terminal set 3, is formed with a predetermined width as X. Each second terminal, came out from the terminal set 3, is formed with a predetermined width as Y. As shown in FIG. 5, five second terminals 32*a*, 32*b*, 32*c*, 32*d* (the second terminal 32*d* has divided into two) have defined a plurality of second terminal 32*a*, 32*b*, 32*c*, 32*d*, and laterally maintain equal width 'Y'. Besides, four first terminals 31*a*, 31*b*, 31*c*, 31*d* have defined a plurality of first terminal, and laterally maintain equal width 'X' (see FIG. 6).

Preferably, the width 'X' is 1.00 mm with a tolerance +/−0.05 mm; the width 'Y' is 0.25 mm with a tolerance +/−0.05 mm. As shown in FIG. 5 and FIG. 6, the first terminal 31*a*, 31*b*, 31*c*, 31*d* formed with width 'X' (hereafter, the first width) is considerably wider than the second terminal 32*a*, 32*b*, 32*c*, 32*d* formed with width 'Y' (hereafter, the second width).

Figures 7, 11:
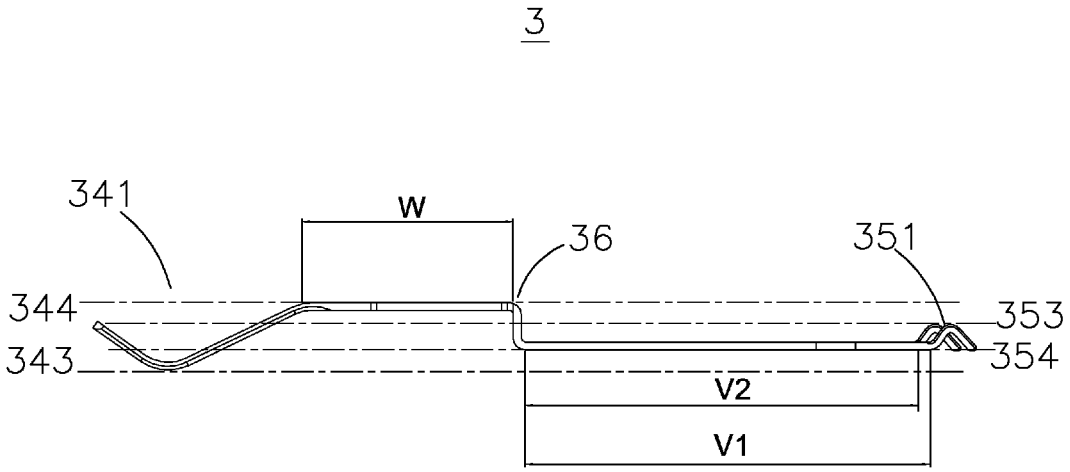
FIG. 7 is a side view shown in FIG. 4.
FIG. 11 is a sheet of the pin assignment of the terminal set formed in accordance with an embodiment of the invention.
Figure 8:
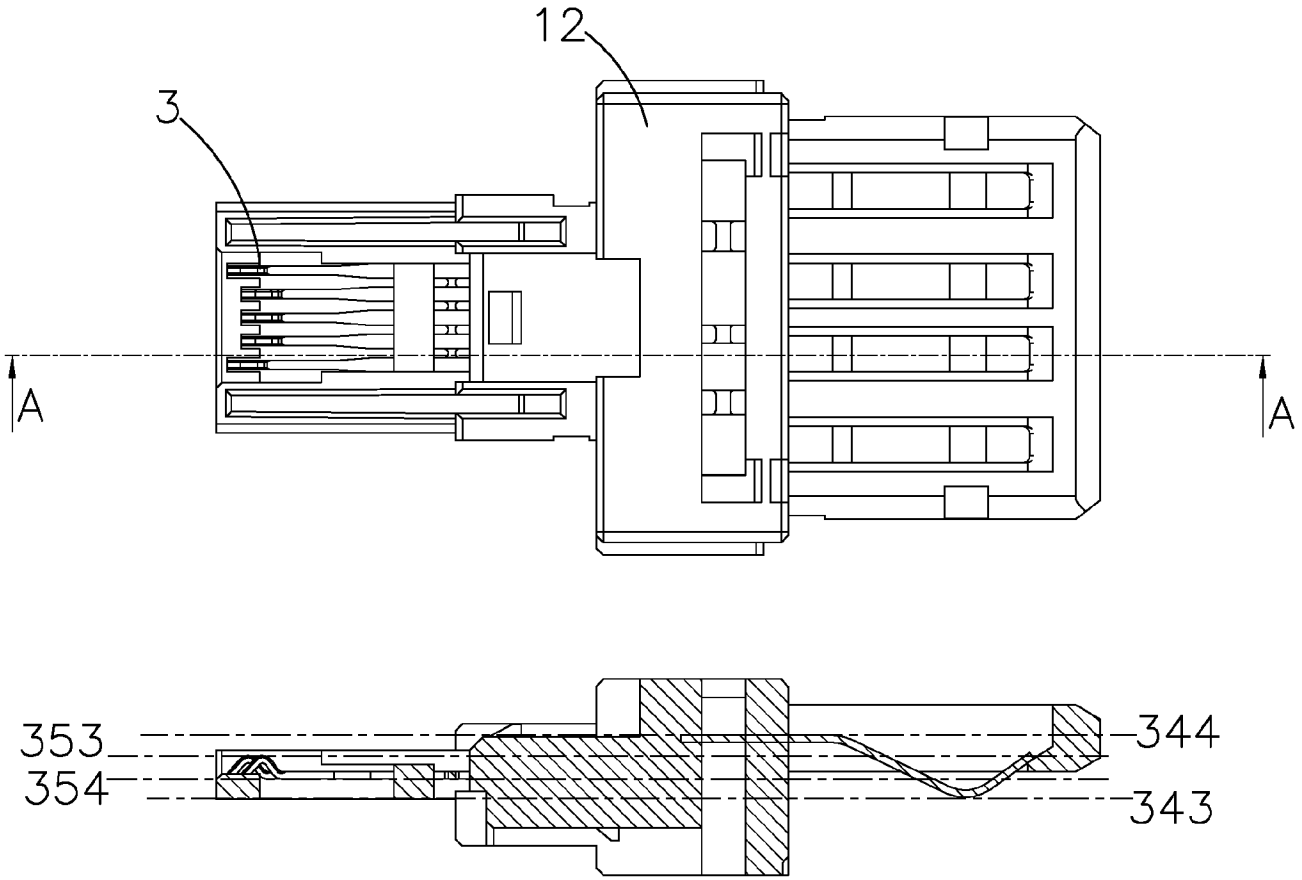
FIG. 8 is a cross-section view of the housing shown in FIG. 2 taken along line A-A.

FIG. 7 illustrates a side view of the terminal set 3 of the connector 9. FIG. 8 illustrates a cross-sectional view of the insulative housing 12 held the terminal set 3 taken along line A-A. The following description of FIGS. 7-8 should be comprehended with FIG. 5 and FIG. 6.

The body portion of the first terminal 31*a*, 31*b*, 31*c*, 31*d* is configured with different levels, wherein a first contact flat surface 343 and a first body flat surface 344 were disposed. As the rear view of the terminal set 3 in FIG. 6, the first contact flat surface 343 is a level that the contact surfaces of all first resilient contacts 341 equally aligned with. The first body flat surface 344 is a level that the body surfaces of all first terminal bodies 342 equally aligned with. The first body flat surface 344 is made higher than the first contact flat surface 343.

The body portion of the second terminal 32*a*, 32*b*, 32*c*, 32*d* is configured with different levels, wherein a second contact flat surface 353 and a second body flat surface 354 were disposed. As the front view of the terminal set 3 in FIG. 5, the second contact flat surface 353 is a level that the contact surfaces of all second resilient contacts 351 equally aligned with. The second body flat surface 354 is a level that the body surfaces of all second terminal bodies 352 equally aligned with. The second body flat surface 354 is made lower than the second contact flat surface 353.

As the side view of the terminal set 3 in FIG. 7, the second contact flat surface 353 is made higher than the first contact flat surface 343; the second body flat surface 354 is made lower than the first body flat surface 344.

As the side view of the terminal set 3 in FIG. 7, the second contact flat surface 353 is made lower than the first body flat surface 344; the first contact flat surface 343 is made lower than the second body flat surface 354.

The following description of FIG. 5 should be comprehended with FIG. 11; FIG. 11 illustrates the contact assignment of the terminal set 3.

The terminal set 3 is made up of a group comprising: the first terminals having a width 'X', that referred to Contact A (31*a*), Contact B (31*b*), Contact C (31*c*) and Contact D (31*d*), are generated longitudinally in one end of the connector 9 to conform a first type standard connector; the second terminal having a width 'Y', that referred to Contact E (32*a*), Contact F (32*b*), Contact G (32*c*) and Contact H (32*d*), are generated longitudinally in the other end of the connector 9 to conform a second type standard connector.

The Contact E (32*a*), or Contact pair E (32*a*), configured with Contact A (31*a*) in opposite direction, comprises two arms. The Contact B (31*b*) is configured with Contact F (32*b*); the Contact C (31*c*) is configured with Contact G (32*c*); and the Contact D (31*d*) is configured with Contact H (32*d*). According to the connectionship of Contacts A-H, using one stamping process to make a terminal set 3 consisted of all four terminals is recommended.

The Contact D (31*d*) is determined to deliver electrical power (VBUS); the Contact C (31*c*) is determined to transmit negative differential signal (D−); the Contact B (31*b*) is determined to transmit positive differential signal (D+); and the Contact A (31*a*) is determined as grounding (GND). Respectively, the Contact H (32*d*) is determined to deliver electrical power (VBUS); the Contact G (32*c*) is determined to transmit negative differential signal (D−); the Contact F (32*b*) is determined to transmit positive differential signal (D+). The Contact pair E (32*a*) is determined to separately provide one Contact as grounding (GND) and the other Contact as switch (detecting), wherein the GND Contact is located away from the center of the terminal set 3.

The terminal set 3 is made up of four independent metallic units which generated out of original one-piece. One of the metallic units provides Contact pair E (32*a*) of predetermined second type standard connector in one end, and Contact A (31*a*) of predetermined first type standard connector in the other end. The rest of the metallic units provide Contact D (31*d*), Contact C (31*c*) and Contact B (31*b*) of predetermined second type standard connector in one end, and Contact H (32*d*), Contact G (32*c*) and Contact F (32*b*) of predetermined first type standard connector in the other end as well.

As shown in FIG. 7, the first terminal 31*a*, 31*b*, 31*c*, 31*d* came out from the terminal set 3 is formed with a predetermined length as W. The second terminal 32*b*, 32*c* came out from the terminal set 3 is formed with a predetermined length as V2; the second terminal 32*a*, 32*d* came out from the terminal set 3 is formed with a longer predetermined length as V1. The first terminal 31*a*, 31*b*, 31*c*, 31*d* having a width 'X' is distinguished from the second terminal 32*a*, 32*b*, 32*c*, 32*d* having a width 'Y' by a demarcation point of which a bending portion 36 consisted.

Preferably, the length 'W' is predetermined as 5 mm with a tolerance +/−0.05 mm; the length 'V1' is predetermined as 11 mm with a tolerance +/−0.05 mm; and the length 'V2' is predetermined as 10 mm with a tolerance +/−0.05 mm. As shown in FIG. 7, the terminal set 3 is respectively extended at a demarcation point defined by the bending portion 36. The first terminal relatively has a length 'W' (hereafter, the first length) which is shorter than the length 'V1' (hereafter, the second length) and the length 'V2' (hereafter, the third length) provided by the second terminals.

Figure 9:
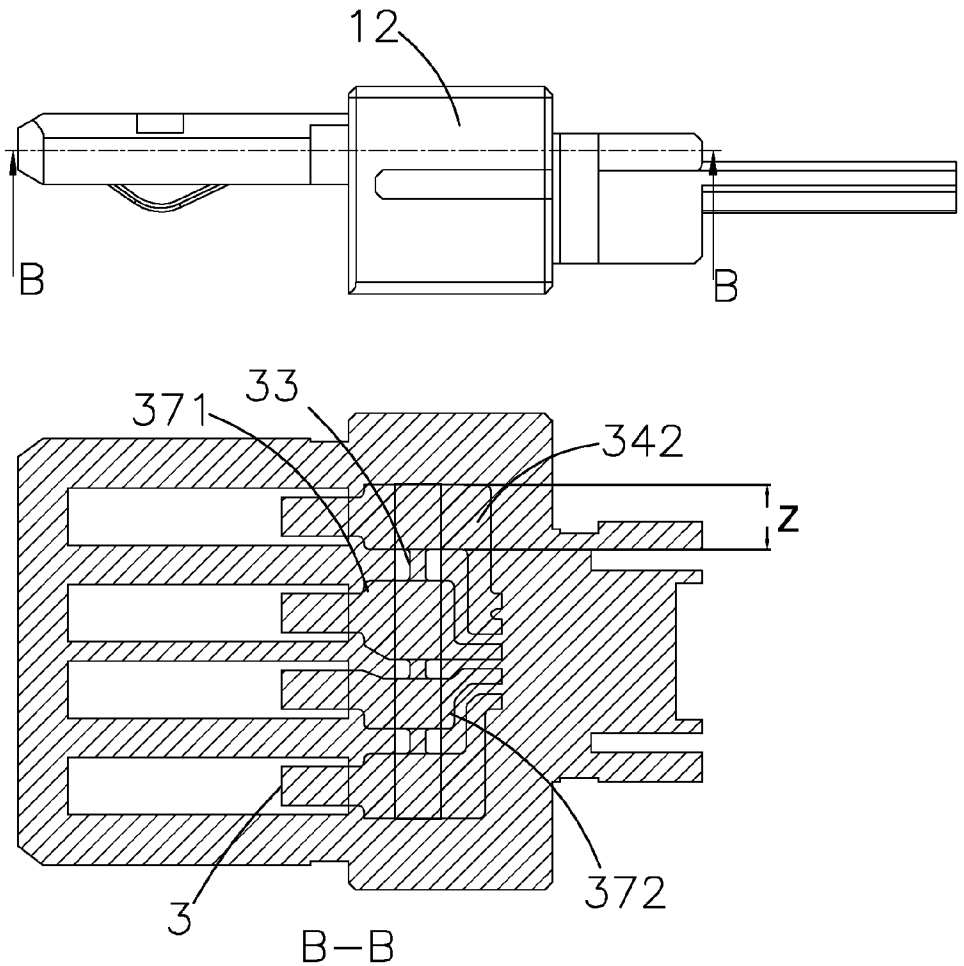
FIG. 9 is a cross-section view of the housing shown in FIG. 2 taken along line B-B.

FIG. 9 illustrates a side view of the terminal set 3 of the connector 9 and a cross-sectional view of the insulative housing 12 held the terminal set 3 taken along line B-B. The cross-sectional view is referred to the upper portion of the insulative housing.

The first terminal 31*a*, 31*b*, 31*c*, 31*d* having a first width 'X' include at least one terminal configuring the first terminal body 342 with a third width 'Z', which is wider than the first width. Preferably, the width 'Z' is predetermined as 1.68 mm with a tolerance +/−0.05 mm.

The first terminals 31*a*, 31*b*, 31*c*, 31*d* having a first width include at least one terminal configuring a first terminal body 342 with a chamfer interfering section 371 toward to the first resilient contact 341, and a surface interfering section 372 toward to the second resilient contact 351, wherein the location of the chamfer interfering section 371 can be replaced with the surface interfering section 372 randomly. In addition, the chamfer interfering section 371 and the surface interfering section 372 are wrapped in the insulative housing 12. Retention force is provide by the chamfer interfering section 371 and the surface interfering section 372, that is much stronger than traditional projection structure.

Figure 10:
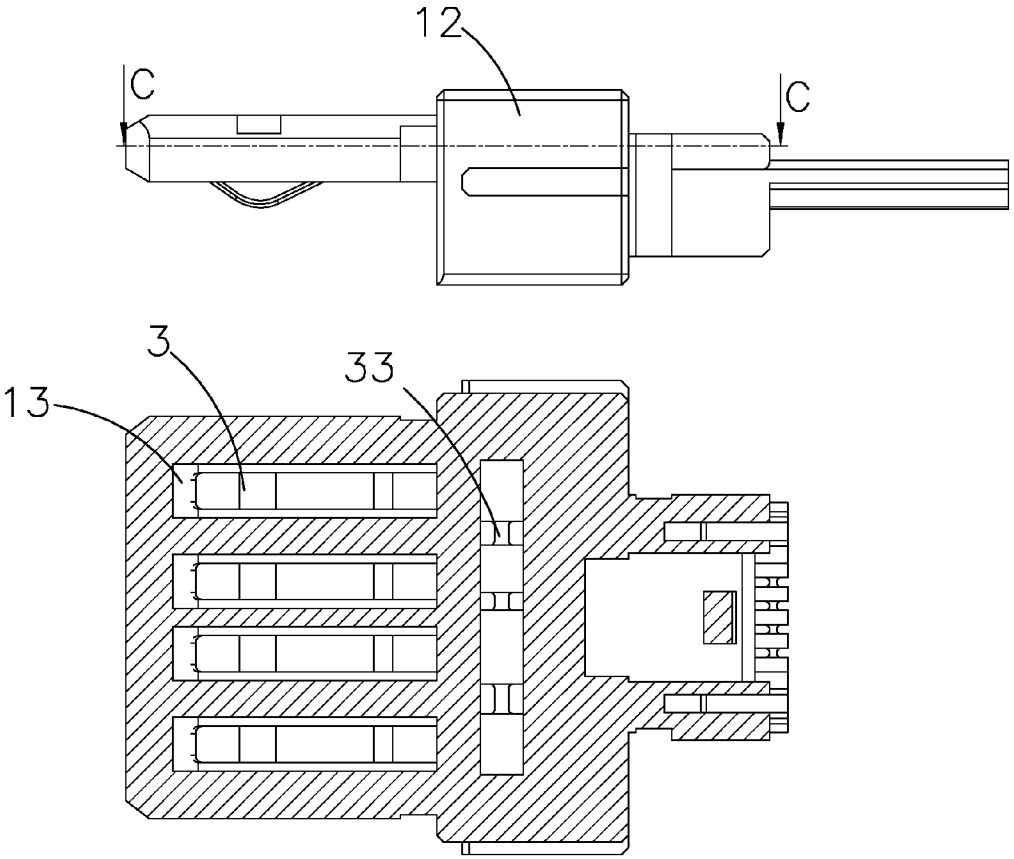
FIG. 10 is a cross-section view of the housing shown in FIG. 2 taken along line C-C.

FIG. 10 illustrates a side view of the terminal set 3 of the connector 9 and a cross-sectional view of the insulative housing 12 held the terminal set 3 taken along line C-C. The cross-sectional view is referred to the bottom portion of the insulative housing 12.

A plurality of grooves 13 is configured between the first terminals 31*a*, 31*b*, 31*c*, 31*d* of the terminal set 3 and the insulative housing 12.

As shown in FIG. 3, the second terminal configures a tapered end at the second resilient contact.

Figure 1:
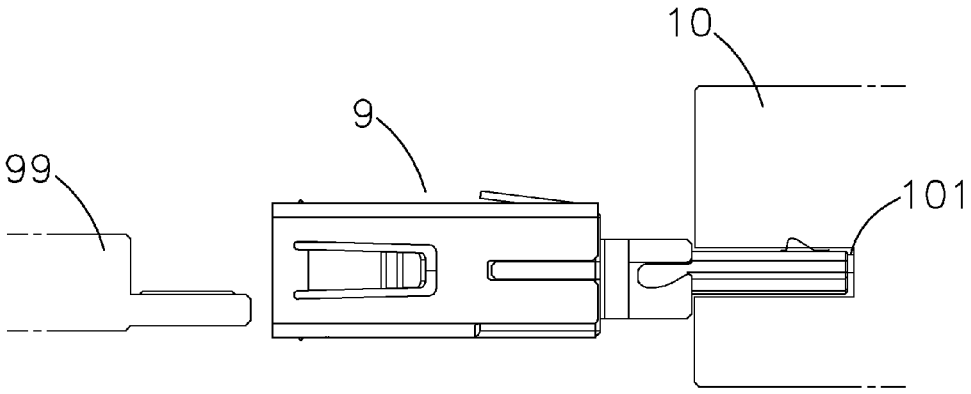
FIG. 1 is a status of use of the (principle) connector formed in accordance with an embodiment of the invention, illustrated the relationship with a supplementary connector and a corresponding connector.

FIG. 1 illustrates a using status of the connector 3 in accordance with the invention. FIG. 1 illustrates an exploded perspective view of the connector 3 in accordance with the invention.

Figure 2:
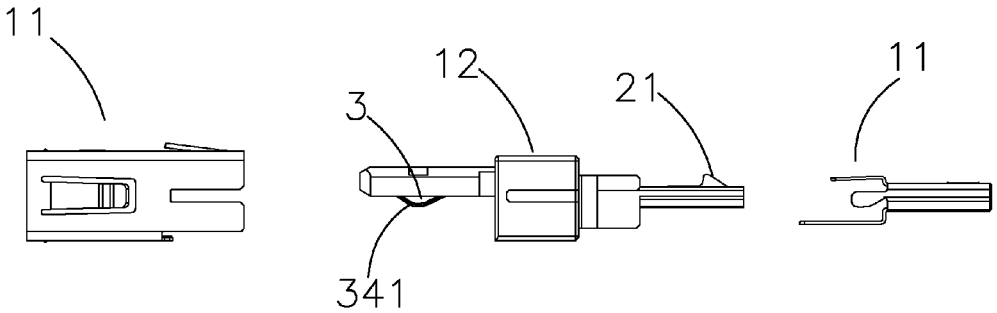
FIG. 2 is an exploded side view of the connector formed in accordance with an embodiment of the invention.

As shown in FIGS. 1-2, a shielding component 11, which usually is a hollow metallic object, contains two independent parts. The terminal set 3 is surrounded in the shielding component 11 so that an electrical shielding is formed; therefore EMI affection is reduced during the transmission via the inserted connector. The connector 9, or the principle connector 9, is inserting in an electric equipment 10 installed a corresponding connector 101; a supplementary connector 99 further is inserting in the principle connector 9. Accordingly, the principle connector 9 is provided as a bridge between the corresponding connector 101 and the supplementary connector 99. It is required how the insulative housing 12 and center of gravity of the terminal set 3 be placed.

The insulative housing 12 is formed by insert-molding process; the terminal set 3 is held in the insulative housing 12, and only the first resilient contact 341 exposes in one direction. A fitting portion 21, which is able to retain the principle connector 9 in the corresponding connector 101, is configuring on the insulative housing 12 in contrast direction, corresponding to the first resilient contact 341.

Figure 12:
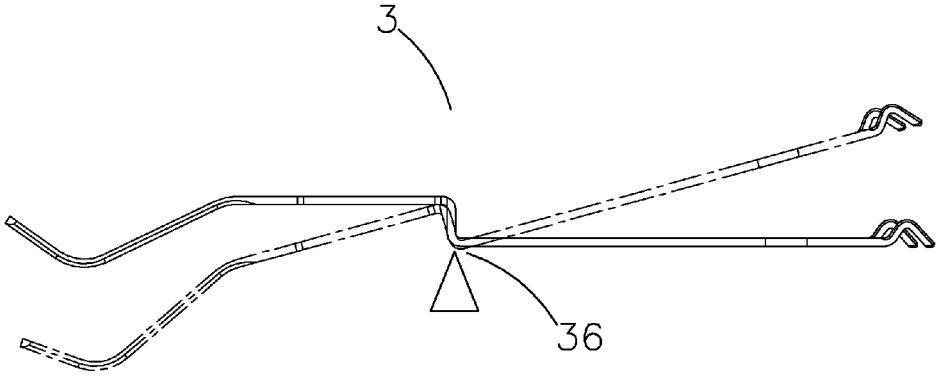
FIG. 12 is a side view shown in FIG. 4, illustrated the gravity balance of the terminal set.
Figure 13:
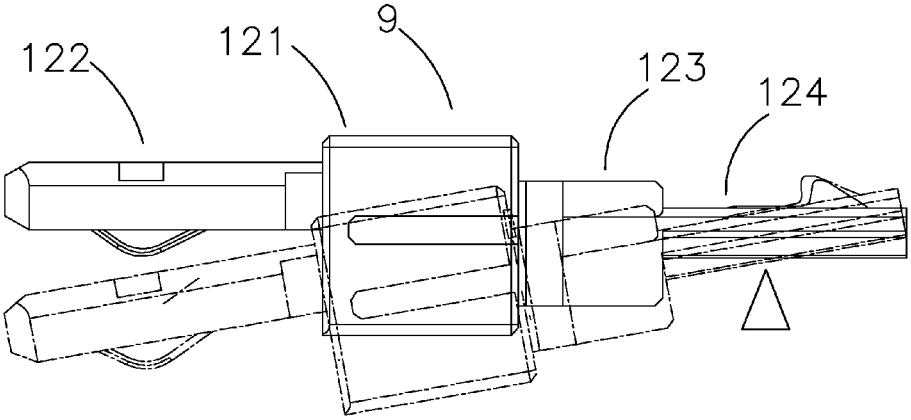
FIG. 13 is a side view of the housing shown in FIG. 2, illustrated the gravity balance of the housing.

FIG. 12 illustrates a side view of the terminal set 3 of the connector 9 in accordance with the invention. FIG. 13 illustrates a side view of the insulative housing 12 held the terminal set 3.

As shown in FIG. 12, a demarcation point is consisted of the bending portion 36. (Also reference to FIG. 3 and FIG. 7) The first terminal of the terminal set 3 has the first length 'W'; the second terminal of the terminal set 3 has the second length 'V1' and the third length 'V2'.

Figure 14:
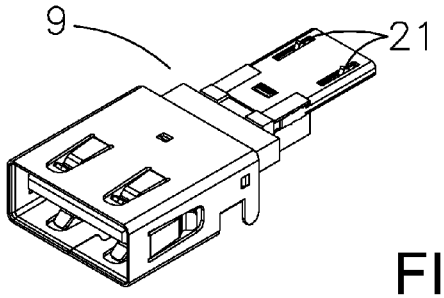
FIG. 14 is a perspective view of the connector formed in accordance with an embodiment of the invention.
Figure 15:
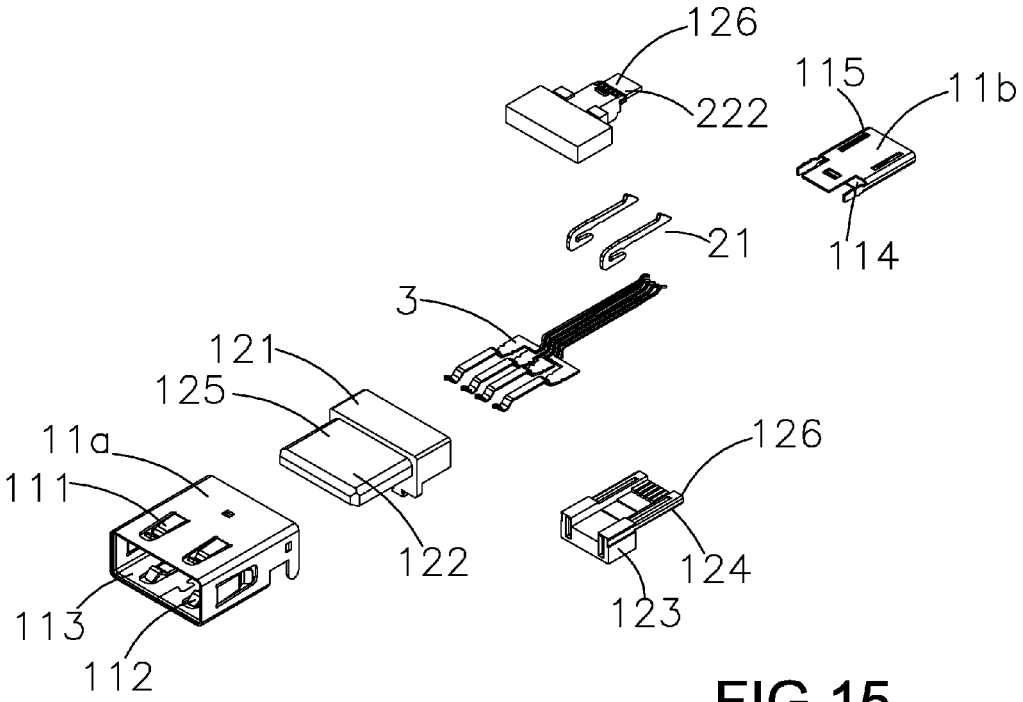
FIG. 15 is an exploded perspective view shown in FIG. 1.
Figure 16:
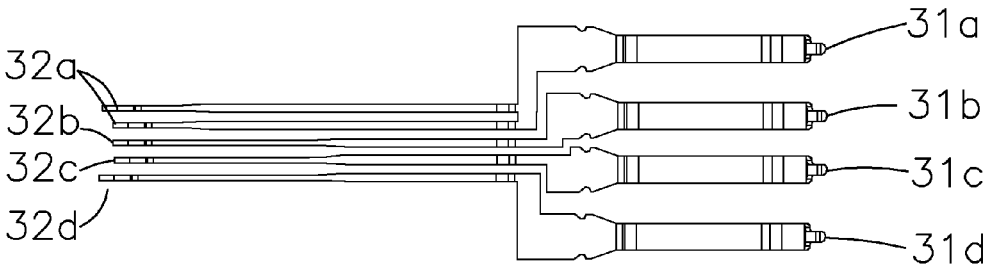
FIG. 16 is a top view of the terminal set formed in accordance with an embodiment of the invention.

As shown in FIGS. 14-16, to produce the connector in accordance with the present invention, a manufacture method was employed, such method comprising the steps of:

(a) Providing a shielding component 11 configured with a first shell 11*a* and a second shell 11*b;*

(b) Providing a terminal set 3;

(c) Molding a housing 12 had a first insulative portion 125 and the second insulative portion 126 with the terminal set 3;

(d) Assembling the molded housing 12 with the shielding component 11.

By the manufacturing process described above, the connector 9 is provided with the following features.

The connector 9 comprises: a first shell 11*a*, made of metal for shielding Electromagnetic Interference, having a first opening 113 at the front end, an upper engaging portion 111 and a lower engaging portion 112, configures with a first insulative portion 125 having a first base portion 121 and a first tongue portion 122, to conform an first type interface. For example, to configure the USB (Universal Serial Bus) socket connector, the height of the first tongue portion 122 is predetermined to be 1.84 mm. The height of the first opening 113 is predetermined to be 5.12 mm. The socket connector is arranged with four contacts. The replacement of the engaging portion 111, 112 is also possible. However, there is no excluded to place the engaging portion 111, 112 in the lateral direction on the opposite side, if the condition of the retention force has been well considered.

A second shell 11*b*, was opposite to the first shell 11*a* in longitudinal direction, having a second opening 114 at the front end and holes 115, configures with a second insulative portion 126 having a second base portion 123 and a second tongue portion 124, to conform an second type interface. For example, to configure the Micro USB plug connector, the height of the second tongue portion 124 is predetermined to be 3.60 mm. The height of the second opening 114 is predetermined to be 1.80 mm. The plug connector is arranged with five contacts.

As shown in FIG. 12, the second insulative portion 126 having a second base portion 123 and a second tongue portion 124 is possible to be formed with the upper and lower body, wherein it can be integrally formed in the state-of-the-art connector of today. Further, holes 115 are provided for the fitting portion 21 partly passing; the passed part of the fitting portion 21 is mounting to the corresponding connector 101 of the electrical equipment 10. The fitting portion 21, which is mounting with holes 115 to the corresponding connector 101, traditionally is composed of a pair of metal part. However, there is no excluded to be formed upon the second shell 11*b* in stamping process, if the condition of the pull-out force has been well considered.

Figure 17:
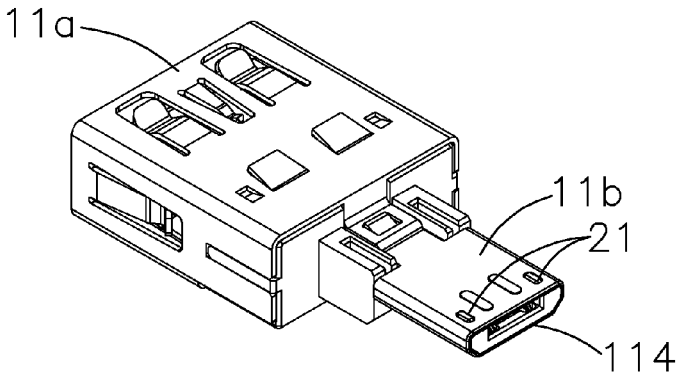
FIG. 17 is another perspective view of the connector formed in accordance with an embodiment of the invention.

The first insulative portion 125 and the second insulative portion 126 are composed of a single part, wherein it can be integrally formed by insert-molding in the state-of-the-art connector of today. In the case of the first shell 11*a*, which covers the first base portion 121 and the first tongue portion 122, and the second shell 11*b*, which covers the second base portion 123 and the second tongue portion 124, the first insulating portion 125 and the second insulative portion 126 are more closed; the volume of the connector 9 therefore reduces. The existing shell finished is possible to be employed to form the first shell 11*a* and the second shell 11*b*. If there are an existing the first shell 11*a* of the first type connector and an existing second shell 11*b* of the second type connector, it is possible to skip the development of new tooling so that the costs can be reducing. Furthermore, there is no excluded to form shells 11*a*, 11*b* integrally in stamping process. Referring to FIG. 17, the first shell 11*a* and the second shell 11*b* are connected to each other.

The so-called insert-mold or envelopment, it assumes that the first insulating portion 125 and the second insulating portion 126 are surrounding to the terminal set 3. In the state-of-the-art connector of today, it is usually to insert the terminals into the channel or gap provided on the housing. However, if the first insulating portion 125 and the second insulating portion 126 to integrally form by insert-molding, the terminal set 3 is completely fixed into the housing 12.

As shown in FIG. 7 and FIG. 12, the terminal set 3, which elongated longitudinally in different end from the bending portion 36, comprises the first terminals 31*a*, 31*b*, 31*c*, 31*d* having a length 'W' which is shorter than the second length 'V1' and the third length 'V2' provided by the second terminal 32*a*, 32*b*, 32*c*, 32*d*. Therefore, the invention considers the preferable configuration of lengths of terminals, and how the insulative housing 12 and center of gravity of the terminal set 3 is placed. The gravity distribution of the connector 9 is shown in imaginary line in FIG. 12. The bending portion 36 is located at the center of gravity of the connector 9, tagged with a triangle. The connector 9 in accordance with the invention provides a better solution for balance of connector.

As shown in FIG. 13, the insulative housing 12 held the terminal set 3 is precisely defined with a first base 121 protruding a first tongue 122 and a second base 123 protruding a second tongue 124. A larger requirement of insulative materials resulted from forming a bigger housing to envelop the first terminals 31*a*, 31*b*, 31*c*, 31*d*; and relatively a less requirement of insulative materials resulted from forming a smaller housing to envelop the second terminals 32*a*, 32*b*, 32*c*, 32*d*. It must takes into account the relationship between the weight of the insulative housing 12 and the length of the terminal set 3. The connector balance shifts to the second tongue 124 somehow, mostly when the connector 9 is inserting to the electric equipment 10.

Referred to FIG. 1 with FIG. 13, the connector 9 is inserting to electric equipment 10. The major part of the connector 9 is hanging on the air, wherein the connector is retained by the corresponding connector 101 solely. The connector balance thus shifts to the second tongue 124 eventually. (See FIG. 13)

While the invention has been described in terms of various specific embodiments, those skilled in the art will recognize that the invention can be practiced with modification within the spirit and scope of the claims.

What is claimed is:

1. A connector, comprising:

a first shell, having a first opening at the front end, an upper engaging portion and a lower engaging portion, configures with a first insulative portion having a first base portion and a first tongue portion to conform an first type interface; and a second shell, opposite to the first shell in longitudinal direction, having a second opening at the front end and at least one fitting portion, configures with a second insulative portion having a second base portion and a second tongue portion to conform an second type interface; and a terminal set, held in a housing composed of said first insulative portion and said second insulative portion, includes a plurality of first terminals and a plurality of second terminals, wherein said terminal set is made up of a group comprising: Contact A, Contact B, Contact C and Contact D defined by said first terminals, are generated longitudinally in one end of the connector to conform an first type interface, Contact E, Contact F, Contact G and Contact H defined by said second terminals, are generated longitudinally in the other end of the connector to conform an second type interface, and configuring said Contact A with said Contact E, said Contact B with said Contact F, said Contact C with said Contact G and said Contact D with said Contact H;

wherein said terminal set is made up of four independent metallic units which generated out of original one-piece; one of the metallic units provides Contact E of the second type interface in one end and Contact A of the first type interface connector in the other end and, wherein said metallic unit, provided Contact E and Contact A in two ends, divides the second terminal into two parts, wherein said metallic unit retains Contact A as single contact and Contact E as a contact pair.

2. The connector as described in claim 1, wherein said contact pair of Contact E consists of one contact used to be as grounding and the other contact used to deliver a detecting signal (as a switch).

3. The connector as described in claim 1, wherein said housing, composed of said first insulative portion and said second insulative portion, is made out of a single part.

4. The connector as described in claim 1, wherein said first base portion and said first tongue portion is covered with said first shell; said second base portion and said second tongue portion is covered with said second shell.

5. The connector as described in claim 1, wherein said first shell and said second shell are integrally formed in single stamping process; said first shell and said second shell are connected to each other.

6. The connector as described in claim 1, wherein said first terminal includes a first resilient contact and a first terminal body; said second terminal includes a second resilient contact and a second terminal body.

7. The connector as described in claim 1, wherein a first contact flat surface and a first body flat surface were disposed on said first terminal; and the a second contact flat surface and a second body flat surface were disposed on said second terminal, wherein said second contact flat surface is higher than said first contact flat surface.

8. The connector as described in claim 1, wherein a first contact flat surface and a first body flat surface were disposed on said first terminal; and a second contact flat surface and a second body flat surface were disposed on said second terminal, wherein said second body flat surface is lower than said first body flat surface.

9. The connector as described in claim 1, wherein a first contact flat surface and a first body flat surface were disposed on said first terminal; and a second contact flat surface and a second body flat surface were disposed on said second terminal, wherein said second contact flat surface is higher than said second body flat surface but lower than said first body flat surface.

10. The connector as described in claim 1, wherein a first contact flat surface and a first body flat surface were disposed on said first terminal; and a second contact flat surface and a second body flat surface were disposed on said second terminal, wherein said first contact flat surface is lower than said second body flat surface.

11. The connector as described in claim 1, wherein each first terminal is formed with a first width; and each second terminal is formed with a second width, wherein said first width is wider than said second width.

12. The connector as described in claim 1, wherein each first terminal is formed with a first length; and at least two second terminal are formed with a second length, wherein said second length is longer than said first length.

13. The connector as described in claim 12, wherein said second terminals having the second length are located in center of all second terminals in the terminal set; and the rest of the second terminals are located away from the center of all second terminals in the terminal set and formed with a third length, wherein said third length is longer than said second length.

14. The connector as described in claim 1, wherein the first terminals is distinguished from the second terminals by a demarcation point defined by a bending portion.

15. The connector as described in claim 6, wherein said second terminal configures a tapered end at said second resilient contact.

16. The connector as described in claim 6, wherein said terminal set is enveloped by said housing; and only the resilient contacts have exposed out.

* * * * *